US011740054B2

(12) United States Patent
Hollars

(10) Patent No.: US 11,740,054 B2
(45) Date of Patent: Aug. 29, 2023

(54) SIGHT SYSTEM FOR PROJECTILE-LAUNCHING DEVICES

(71) Applicant: Anthony Hollars, Tucson, AZ (US)

(72) Inventor: Anthony Hollars, Tucson, AZ (US)

( * ) Notice: Subject to any disclaimer, the term of this patent is extended or adjusted under 35 U.S.C. 154(b) by 270 days.

(21) Appl. No.: 16/216,374

(22) Filed: Dec. 11, 2018

(65) Prior Publication Data

US 2019/0346236 A1 Nov. 14, 2019

Related U.S. Application Data

(63) Continuation of application No. 14/989,314, filed on Jan. 6, 2016, now Pat. No. 10,151,562.

(60) Provisional application No. 62/100,363, filed on Jan. 6, 2015.

(51) Int. Cl.
*F41G 1/467* (2006.01)

(52) U.S. Cl.
CPC ..... *F41G 1/467* (2013.01)

(58) Field of Classification Search
CPC ..... F41G 1/467
See application file for complete search history.

(56) References Cited

U.S. PATENT DOCUMENTS

| | | | | |
|---|---|---|---|---|
| 8,046,951 | B2 * | 11/2011 | Peters | F41G 3/08 42/114 |
| 9,429,392 | B1 * | 8/2016 | Ledbetter | F41G 1/35 |
| 10,151,562 | B1 * | 12/2018 | Hollars | F41G 1/467 |
| 2004/0005531 | A1 * | 1/2004 | Varshneya | F41G 1/54 434/22 |
| 2007/0137088 | A1 * | 6/2007 | Peters | F41G 3/142 42/106 |
| 2010/0115778 | A1 * | 5/2010 | Gorsuch | F41G 1/467 356/3 |
| 2014/0331985 | A1 * | 11/2014 | Samuels | G01C 3/06 124/87 |
| 2015/0090244 | A1 * | 4/2015 | Samuels | G01P 3/665 124/87 |
| 2019/0346236 | A1 * | 11/2019 | Hollars | F41G 1/467 |

* cited by examiner

*Primary Examiner* — Yaritza Guadalupe-McCall
(74) *Attorney, Agent, or Firm* — Dale Regelman

(57) ABSTRACT

A method to aim an arrow at a target, where the method includes providing a bow, an arc track attached to the bow via a mount assembly, a front sight disposed on a distal end of a sight line support and a rear sight disposed on a proximal end of the sight line support, the method further including sliding the sight line support upwardly or downwardly along the arc track until a target is visibly aligned with both the front sight and the rear sight where as sight line support slides upwardly, the sight line support rotates clockwise and as sight line support 103 slides downwardly, the sight line support rotates counterclockwise.

7 Claims, 6 Drawing Sheets

SIGHT SYSTEM FOR PROJECTILE-LAUNCHING DEVICES

CROSS REFERENCE

This application is a Continuation Application of U.S. Non-Provisional application Ser. No. 14/989,314, filed Jan. 6, 2016, now U.S. Pat. No. 10,151,562, which claimed priority to Provisional Patent Application No. 62/100,363 filed Jan. 6, 2015, the specification of which is incorporated herein in its entirety by reference.

FIELD OF THE INVENTION

The present invention relates to a method using a sight system for bows and crossbows and other similar projectile-launching devices.

BACKGROUND OF THE INVENTION

Sights for accurately placing a projectile (such as an arrow) into a target have evolved from ones using instinct and practice to very complex mechanical devices. For example, in primitive archery, a bow was very simple and had a limited effective range. The use of a device to aim the bow was not needed. As materials and design became better and bows became capable of much faster arrow speeds and range, sighting devices became popular. Prior art sights share come common features: they have a rear peep sight mounted in the bowstring or a rear sight mounted to the bow, and they use these rear sights to align with a front sight to aim at the target.

An example of a rear sight reference is a peep sight woven into the bowstring. Without wishing to limit the present invention to any theory or mechanism, it is believed that the configuration with the peep sight woven into the bowstring may present challenges, for example the small aperture may cause difficulty in seeing targets in low-light settings. And, it may cause the eye to have to focus at three ranges: just in front of the eyeball, at the front sight, and at the target some yards away.

The use of multiple reference points may lead to inaccuracies (e.g., one or more of the reference points end up out of focus). In some cases, the front sight has multiple pins stacked vertically. These sights may cause the archer to move the drawn anchor position to view the pins for different ranges. Other types of sights have a single sight line but with multiple reference points, wherein the sight line is moved vertically to compensate for different ranges (see FIG. 1 showing an example of the prior art), e.g., to compensate for distance or a movable front sight that can be placed at the correct height for the range. While these may be effective for a single range or narrow set of distances, they may present challenges because of the large movement of the sight required to compensate for the trajectory of an arrow.

There have been attempts to have a better sight line in archery. Some examples include peep sights for bowstrings that have multiple apertures spaced apart to allow the front sights to be used at multiple ranges. With this type of sight, the archer must move the shooting stance and anchor point of the bow at full draw, which can result in inaccuracy.

Many attempts to allow the use of a front and rear sight mounted to the handle as opposed to using a peep sight as the rear sight reference have been introduced. These often do not provide the alignment of the sight line to the archers eyeball over a large range of distance settings. Some have a movable rear sight and some have a movable front sight. These are usually movable with a parallelogram style, pivot, or vertical, adjustment (Examples are the fine line rear sight by ProMaster™ and the Hind Sight™ by Precision Sighting Systems.)

There are also numerous sights that allow for rifle sights, telescopic sight or holographic sights to be used in archery. They can be used in one narrow range such as a target shooting at a specific yardage, but oftentimes these do not allow the sight to be used over a range of distances without the movement of the sight causing the misalignment of the sight line between the archers eye and the target so significantly that the archers anchor point at full draw and stance are greatly affected compromising accuracy (e.g., Messer Optics,™Opti-mount™)

SUMMARY OF THE INVENTION

The present invention features an archery sight system that is adjustable for distance of a target along an arc that always aligns a sight line perfectly with an archer's eye so that use of any type of sight is allowable without moving the correct draw position and nock point allowing for better accuracy.

The present invention features a sight system for a projectile-launching device. In some embodiments, the sight system comprises a sight line support and a curved arc track. In some embodiments, the distal end of the sight line support is slidably attached to the arc track via a moveable attachment such that the sight line support can move in at least a first direction and a second opposite direction along at least a portion of the ark track.

In some embodiments, the sight line support is slidably attached to the arc track such that at any position the sight line support occupies along the arc track, the sight line support is perpendicular to a tangent of the arc track, the tangent being a line tangent to the arc track at a point formed where the sight line support intersects with the arc track.

In some embodiments, the projectile-launching device comprises a bow, and the arc track is attached to the bow via a mount assembly. In some embodiments, the mount assembly comprises a bolt adapted to engage threaded holes within the bow.

In some embodiments, a line L is formed from (a) a point P, point P being where the sight line support intersects with the arc track and (b) point C, point C being a center of a circle formed by the arc track, wherein line L is equal for any position the sight line support occupies along the arc track (see FIG. 6). In some embodiments, the arc track has a radius of curvature that is equal to line L. In some embodiments, point C is where an archer aligns his eyeball.

In some embodiments, the movable attachment comprises a roller. In some embodiments, a front sight is disposed on a distal end of the sight line support and rear sight is disposed on a proximal end of the sight line support. In some embodiments, the front sight and the rear sight comprise iron rifle sights, telescopic sights, holographic sights, or pin sights.

The present invention also features a sight system comprising a sight line support and a pivot system, wherein the pivot system simulates a track, e.g., a track along which the sight line support can slide.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DETAILED DESCRIPTION OF THE INVENTION

Figure 1:
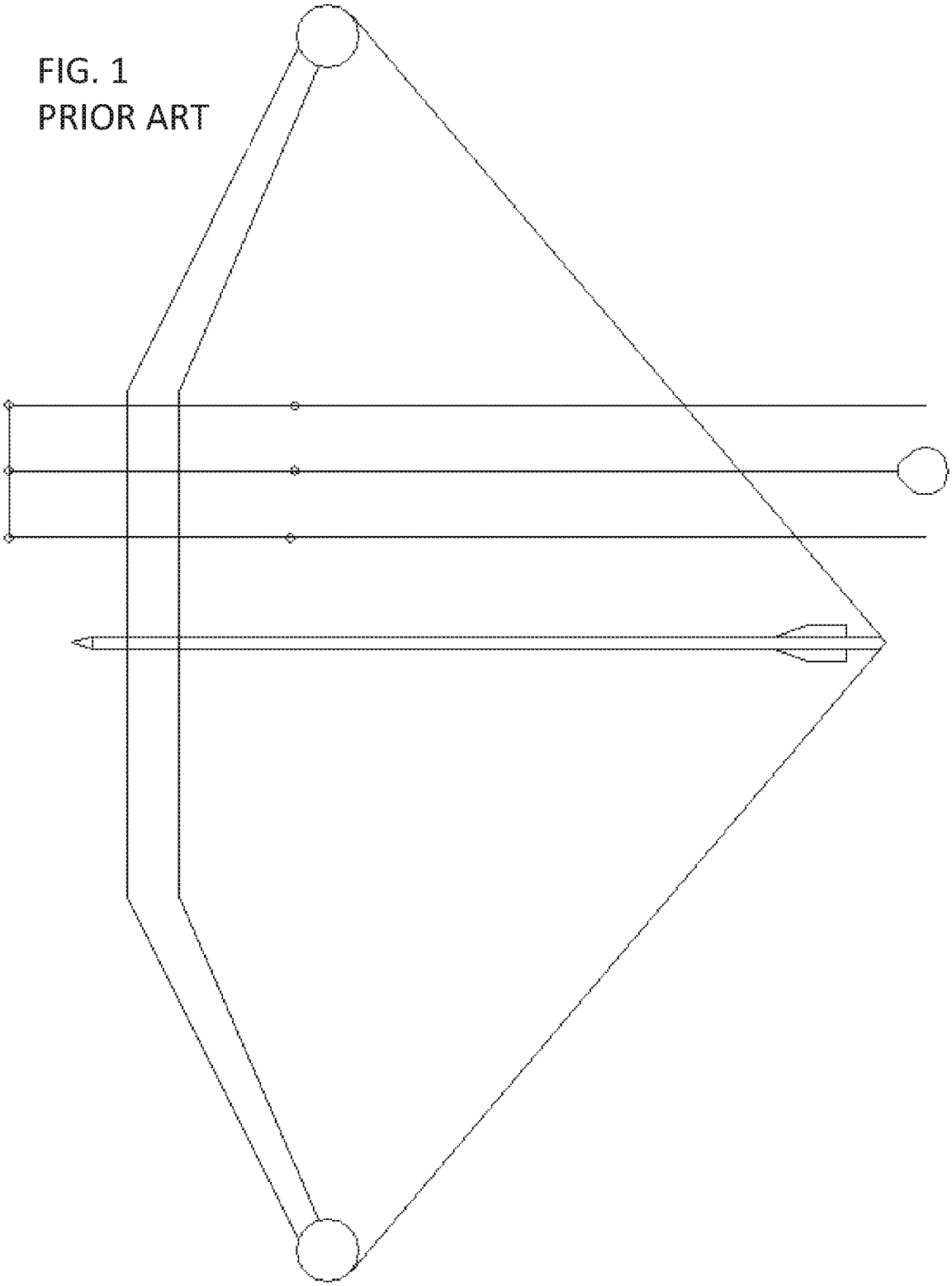
FIG. 1 PRIOR ART
FIG. 1 (prior art) shows a lack of alignment with the eyeball with vertical movement (if a particular prior art sight is used—note that a sight is not shown)
Figure 2:
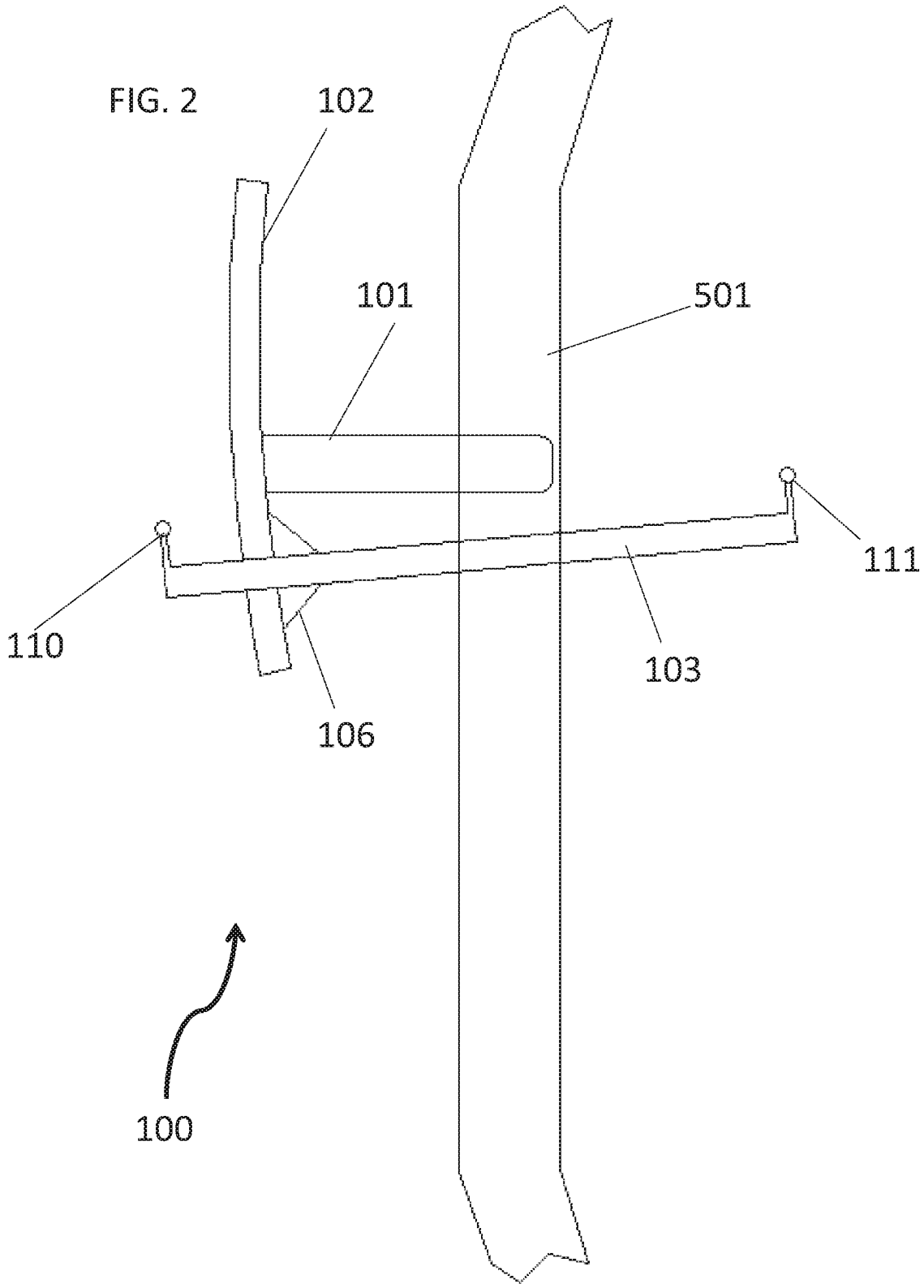
FIG. 2 shows a side view of a sight system of the present invention.
Figure 3:
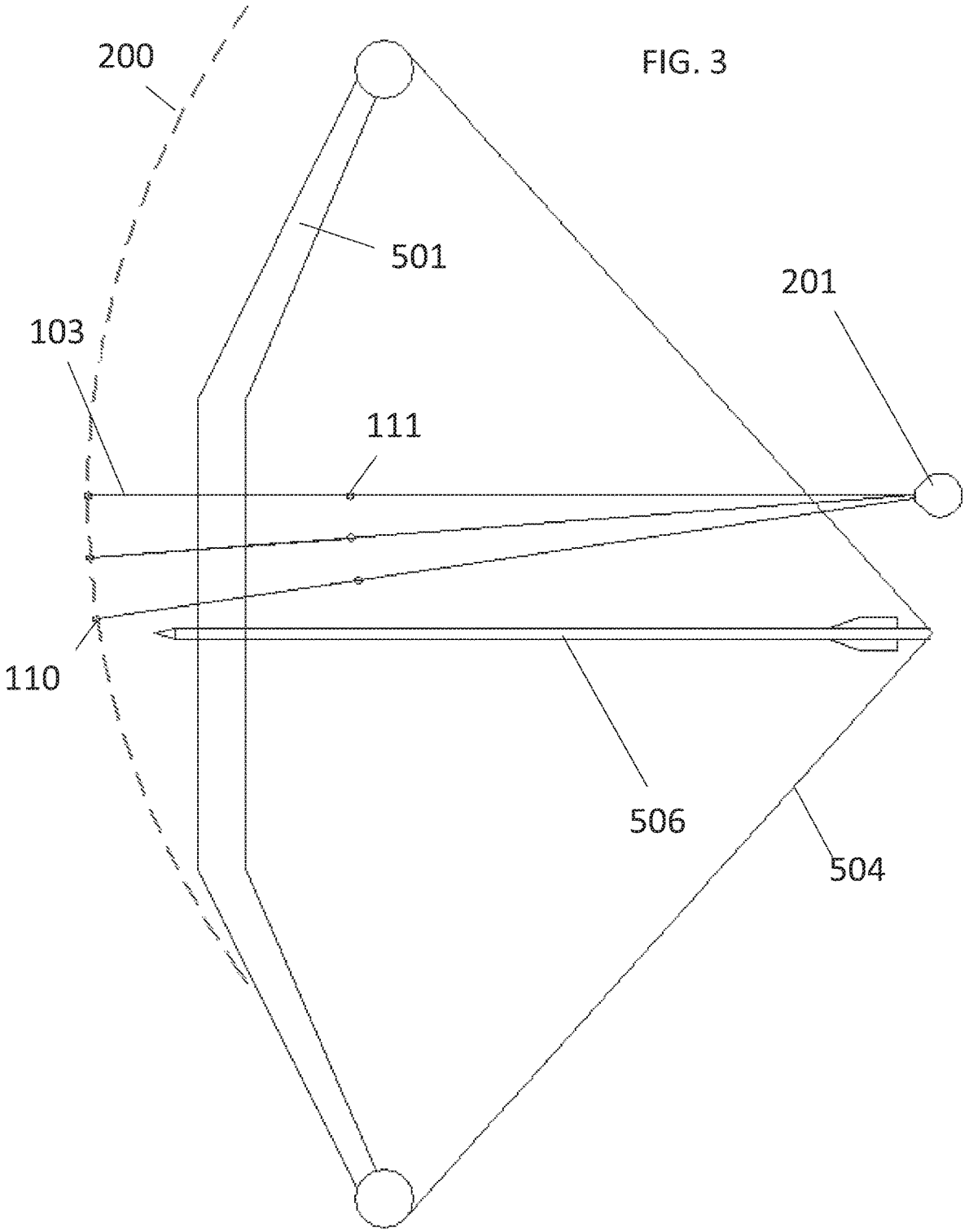
FIG. 3 shows a diagram illustrating lines of sight of the archer's eye using the system of the present invention.
Figure 4:
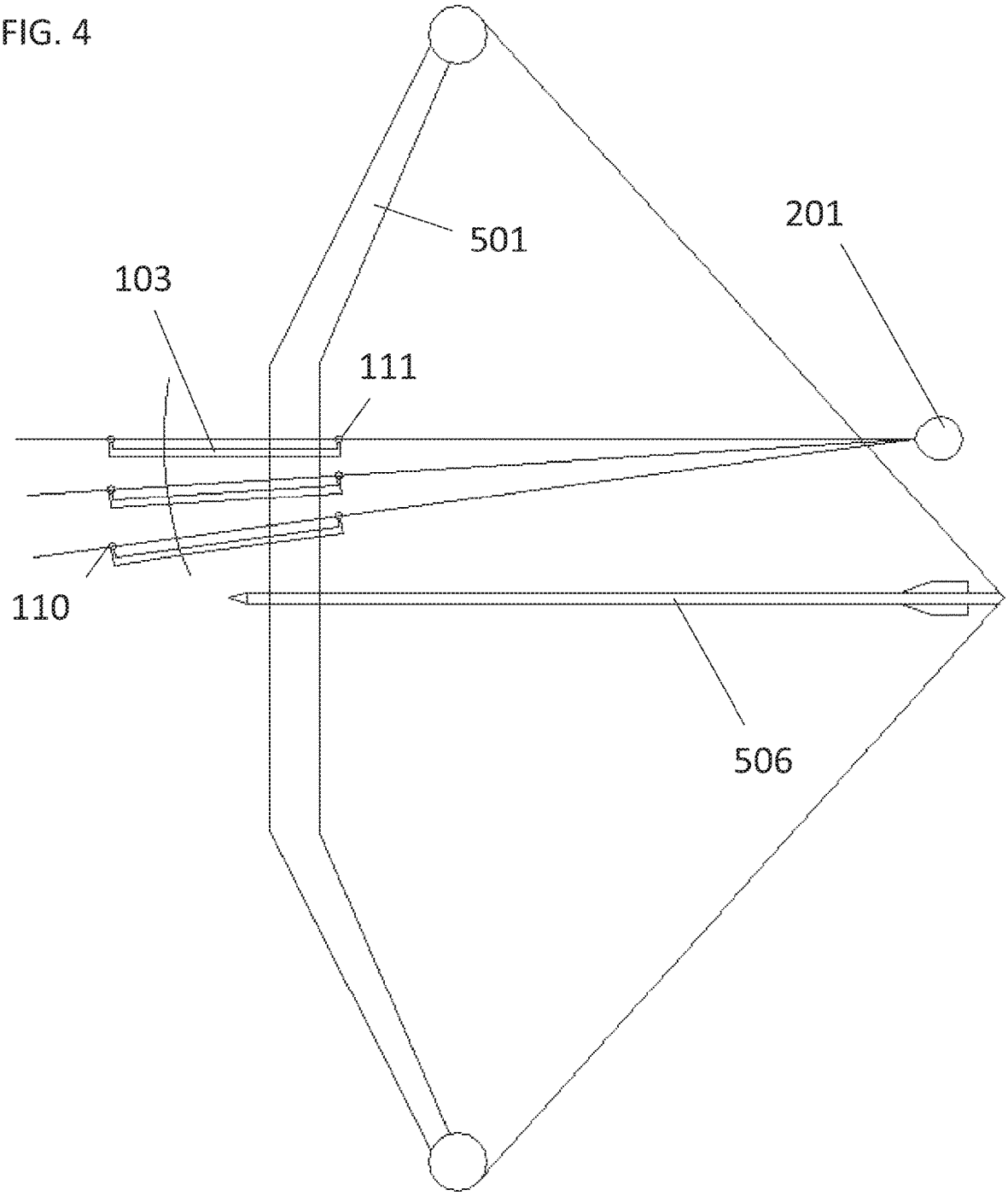
FIG. 4 shows a diagram illustrating lines of sight of the archer's eye using the system of the present invention.
Figure 5:
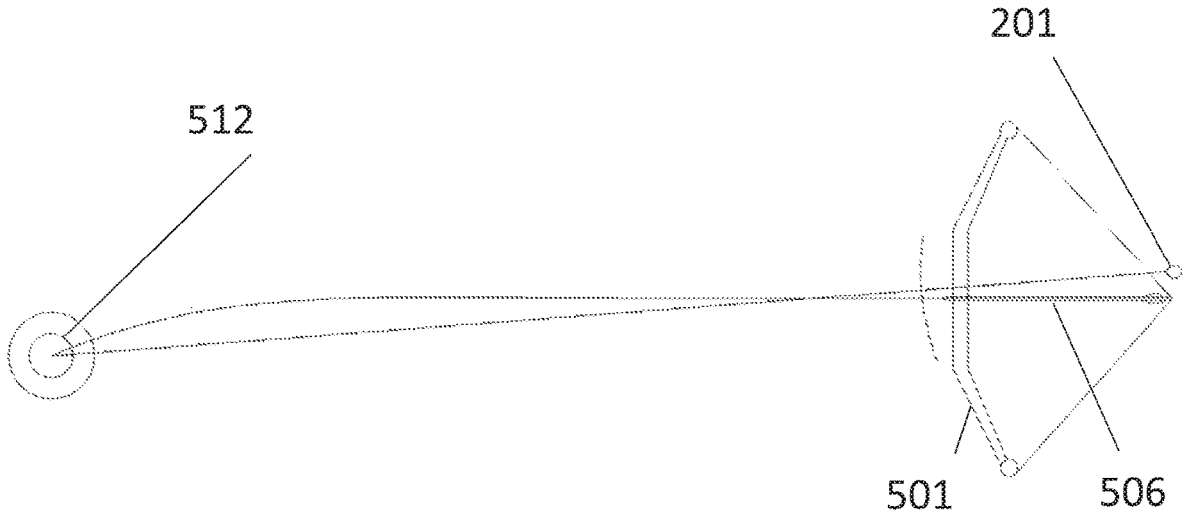
FIG. 5 shows a schematic representation of a line of sight (from the eyeball to the target) and the trajectory of the arrow.
Figure 6:
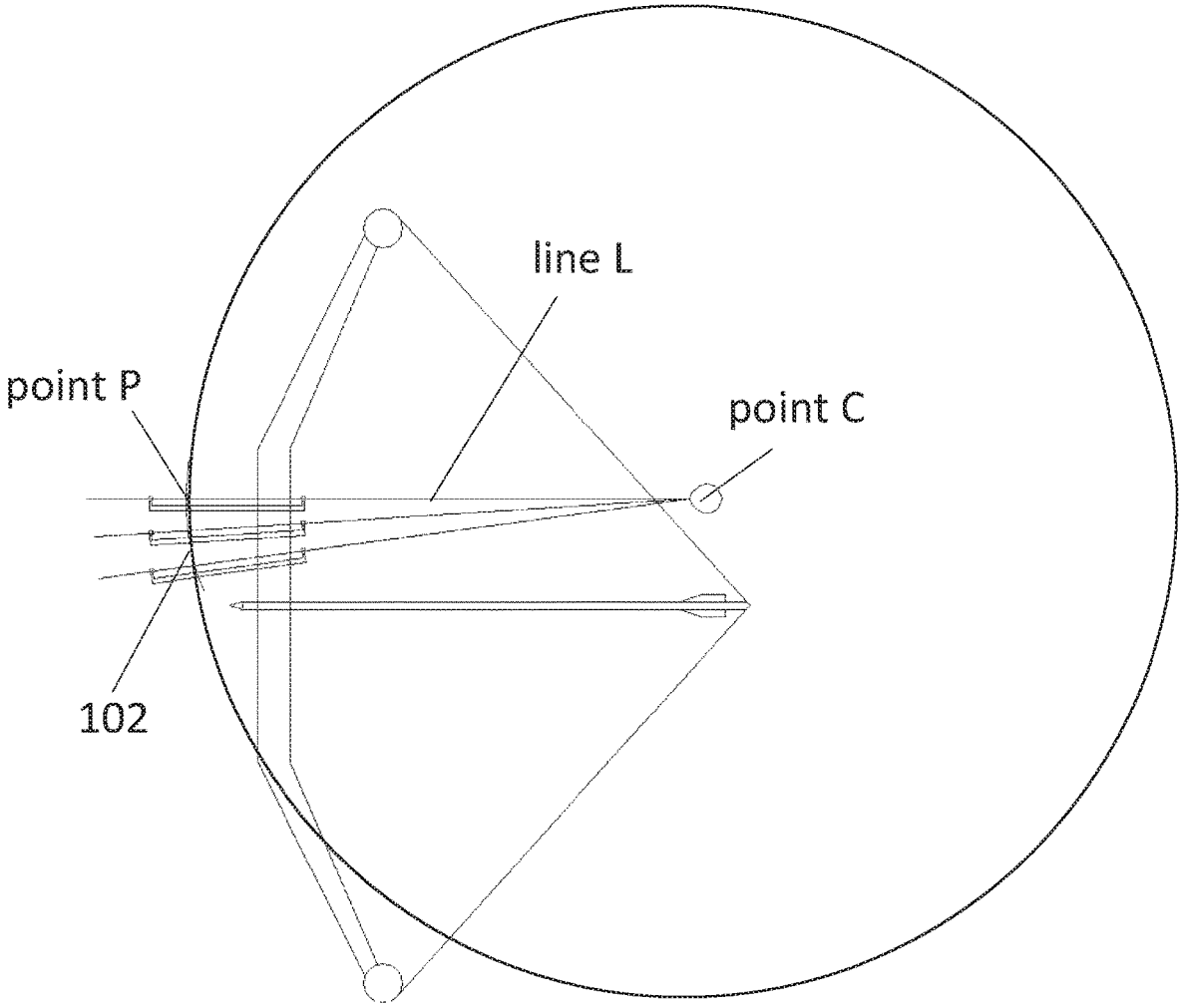
FIG. 6 shows a schematic view of a circle formed by the arc track. (Note: circle and other components are not necessarily drawn to scale.)

Following is a list of elements referred to herein:

100 sight system
101 mount assembly
102 arc track
103 sight line support
106 attachment
110 front sight
111 rear sight
201 eyeball
501 bow handle
504 bowstring
506 arrow
512 target Referring now to FIGS. 2-6, the present invention features a sight system (100) for bows, crossbows, or other projectile-launching devices. The sight system (100) of the present invention allows for accurate alignment of an arrow for reaching a target. For reference, FIG. 5 shows a line of sight extending from the eyeball (201) of an archer to a target (512) with the arrow (506) in position as shown.

The sight system (100) of the present invention comprises a mount assembly (101) having a proximal end that is attached or can be attached to a bow (501) or other appropriate component and a distal end (the distal end being opposite the proximal end). Disposed on the distal end of the mount assembly (101) is an arc track (102). The arc track (102) has a radius of curvature and arc length. The arc length and radius of curvature can be determined as appropriate for the application.

The system (100) of the present invention further comprises a sight line support (103), which is slidably attached to the arc track (102) via a movable attachment (106). In some embodiments, the movable attachment (106) can be rollers, a V-shaped follower, or other appropriate component that allows movement or sliding of the sight line support (103) along the arc track (102). The sight line support (103) can move in at least a first direction and a second (e.g., opposite) direction along the arc track (102), e.g., upwardly and downwardly along the arc track (102).

In some embodiments, the sight line support (103) is supported on the movable attachment so that it can be moved to a position along the arc track (102) to allow the sight line to be positioned correctly for any distance the archer chooses. In some embodiments, the mount assembly (101) is rigidly attached to the bow handle (501). In some embodiments, the mount assembly (101) comprises bolts that fit threaded holes pre-formed in the handle of a typical bow, however the present invention is not limited to these components and includes any other appropriate component for attaching the arc track (102) to the bow (501). In some embodiments, the sight line support (103) is movably attached so that it is always perpendicular to a tangent of the arc track (102) in any position.

In some embodiments, the sight line support (103) comprises a front sight pin (110) disposed on the distal end of the sight line support (103) and rear sight pin (111) disposed on the proximal end of the sight line support (103). The sight pins (110, 111) may comprise any appropriate sighting device including but not limited to iron rifle sights, telescopic sights, holographic sights, or typical pin sights used in archery.

In some embodiments, the arc track (102) has a radius of curvature that is same or similar to the distance between the arc track (102) and a point behind the bow (e.g., a point that is where the archer's eyeball will be when in use). This may allow for the sight line support (103) to align with the archer's eye (e.g., unlike some prior art sights that move along pivots or vertical tracks to adjust for range).

FIG. 3 and FIG. 4 show a bow (501) (e.g., comprised of a handle, a pair of limbs, a bowstring (504) and an arrow (506) ready to be released. The sight line support (103) is shown in multiple portions along the arc (200) formed by the arc track (102) (e.g., the radius at the distance from the track (102) to the archers eyeball (201)). The different positions represent the sight line support (103) placed for different ranges of shooting from further (lower sight line represented) to closer (top sight line represented).

In FIG. 3 and FIG. 4, the front sight (110) and rear sight (111) in each of the sight line examples are shown in alignment with the archer's eye (201) and the sight line. It is apparent that changing the position of the sight line to accommodate different ranges with the invention result in the sight line always being aligned with the archers eye.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

I claim:

1. A method to aim an arrow at a target, comprising: providing a bow (501), an arc track (102) attached to the bow (501) via a mount assembly (101); establishing an initial sight line between a shooter's eye and a target; wherein: as the target moves further away from the shooter, the initial sight line slides downwardly along the arc track to form a first revised sight line; as the target moves closer to the shooter, the initial sight line slides upwardly along the arc track to form a second revised sight line; the initial sight line is not parallel to the first revised sight line; the initial sight line is not parallel to the second revised sight line; the first revised sight line is not parallel to the initial sight line; the first revised sight line is not parallel to the second revised sight line; the second revised sight line is not parallel to the initial sight line; the second revised sight line is not parallel to the initial sight line, and is not parallel to the first revised sight line.

2. The method of claim 1, further comprising as the target moves further away from the shooter, the initial sight line pivots in a first direction to form said first revised sight line.

3. The method of claim 2, further comprising as the target moves closer to the shooter, the initial sight line pivots in a second, and opposite, direction to form said second revised sight line.

4. The method of claim 1, further comprising: providing a front sight (110) disposed on a distal end of a sight line support (103) and a rear sight (111) disposed on a proximal end of the sight line support (103); wherein: sight line support (103) is slidably attached to the arc track (102) via a moveable attachment (106); at any position the sight line support (103) occupies along the arc track, the sight line support (103) is perpendicular to a tangent of the arc track (102), the tangent being a line tangent to the arc track (102) at a point formed where the sight line support (103) intersects with the arc track (102); sight line support (103) can move in at least a first direction and a second opposite direction along at least a portion of the arc track (102); the method further comprising: sliding said sight line support upwardly or downwardly along the arc track until a target is visibly aligned with both the front sight and the rear sight; wherein: as sight line support (103) slides upwardly, sight line support (103) pivots in a first direction; and as sight line support (103) slides downwardly, sight line support (103) pivots in a second, and opposite, direction.

5. The method of claim 4, wherein: the arc track defines a center point and a radius of curvature; said radius of curvature equals the distance between said center point and an intersection of sight line support (103) and arc track (102); said method further comprising: adjusting a length of said sight line support such that said radius of curvature is essentially collocated with the location of a shooter's eye.

6. The method of claim 5, further comprising as the target moves away from the shooter, the sight line moves downwardly along said arcuate path, and pivots in a first direction, to form a first revised sight line, wherein that first revised sight line is not parallel to the initial sight line.

7. The method of claim 6, further comprising as the target moves closer to the shooter, the sight line moves upwardly along said arcuate path, and pivots in a second, and opposite, direction, to form a second revised sight line, wherein the second revised sight line is not parallel to either the initial sight line, and is not parallel to the first revised sight line.

* * * * *